US010123932B2

(12) United States Patent
Nagasaka

(10) Patent No.: US 10,123,932 B2
(45) Date of Patent: Nov. 13, 2018

(54) MOTION ASSIST DEVICE AND MOTION ASSIST METHOD

(71) Applicant: SONY CORPORATION, Tokyo (JP)

(72) Inventor: Kenichiro Nagasaka, Tokyo (JP)

(73) Assignee: SONY CORPORATION, Tokyo (JP)

( * ) Notice: Subject to any disclaimer, the term of this patent is extended or adjusted under 35 U.S.C. 154(b) by 1046 days.

(21) Appl. No.: 13/971,949

(22) Filed: Aug. 21, 2013

(65) Prior Publication Data

US 2014/0100492 A1 Apr. 10, 2014

(30) Foreign Application Priority Data

Oct. 4, 2012 (JP) ..... 2012-221907

(51) Int. Cl.
*A61H 3/00* (2006.01)
*A61H 3/06* (2006.01)
*A61H 1/02* (2006.01)

(52) U.S. Cl.
CPC ..... *A61H 3/061* (2013.01); *A61H 1/0262* (2013.01); *A61H 3/00* (2013.01); *A61H 2201/1215* (2013.01); *A61H 2201/14* (2013.01); *A61H 2201/1463* (2013.01); *A61H 2201/164* (2013.01); *A61H 2201/165* (2013.01); *A61H 2201/1628* (2013.01); *A61H 2201/5028* (2013.01); *A61H 2201/5061* (2013.01); *A61H 2201/5069* (2013.01)

(58) Field of Classification Search
CPC ..... B25J 9/0006; B25J 9/104; B25J 9/1045; A61H 3/00; A61H 1/0262; B66D 1/12; B66D 2700/026
USPC ..... 700/170, 245, 253, 254, 256, 260, 261; 601/33–35
See application file for complete search history.

(56) References Cited

U.S. PATENT DOCUMENTS 2,535,489 A * 12/1950 Edwards ..... A61F 2/58 623/24
3,976,206 A * 8/1976 Flatau ..... B25J 3/00 294/86.4

(Continued)

FOREIGN PATENT DOCUMENTS

| | | |
|---|---|---|
| JP | 2011-062463 | 3/2011 |
| JP | 4715863 | 7/2011 |
| KR | 20120082219 A * | 7/2012 |

OTHER PUBLICATIONS

Hiroaki Kawamoto, et al., Power Assist Method for HAL-3 using EMG-based Feedback Controller, Systems, Man and Cybernetics, 2003, pp. 1648-1653, vol. 2, IEEE, Tsukuba, JP.

(Continued)

*Primary Examiner* — Michael Tsai
*Assistant Examiner* — Christopher Miller
(74) *Attorney, Agent, or Firm* — Paratus Law Group, PLLC

(57) ABSTRACT

There is provided a motion assist device including a jth link worn on a jth portion of a user, an ith joint unit connected at one end of an ith link in a freely rotatable manner, a (j+1)th link worn on a (j+1)th portion of the user, an (i+1)th joint unit integral with one end of the (j+1)th link and coupled to the other end of the jth link, a single actuator installed at one of the jth link and a link adjacent to the jth link, and a transmission part transmitting a driving force of the actuator to the ith joint unit and the (i+1)th joint unit.

12 Claims, 10 Drawing Sheets

(56) References Cited

U.S. PATENT DOCUMENTS 4,067,070 A * 1/1978 Seamone ..... A61F 2/58 623/24
4,074,367 A * 2/1978 Loveless ..... A61F 2/58 623/24
4,232,405 A * 11/1980 Janovsky ..... A61F 2/582 623/43
4,604,098 A * 8/1986 Seamone ..... A61F 2/582 623/60
4,865,376 A * 9/1989 Leaver ..... B25J 9/1045 294/111
4,986,723 A * 1/1991 Maeda ..... B25J 9/06 294/111
5,207,114 A * 5/1993 Salisbury, Jr. ..... B25J 9/046 414/7
5,213,094 A * 5/1993 Bonutti ..... A61F 5/0123 601/33
5,456,268 A * 10/1995 Bonutti ..... A61F 5/0123 128/898
5,549,712 A * 8/1996 Gammer ..... A61F 2/582 623/57
5,570,920 A * 11/1996 Crisman ..... B25J 9/104 294/111
5,685,830 A * 11/1997 Bonutti ..... A61F 5/013 601/33
5,710,870 A * 1/1998 Ohm ..... B25J 3/04 700/245
5,828,813 A * 10/1998 Ohm ..... B25J 3/04 700/260
6,668,678 B1 * 12/2003 Baba ..... B25J 9/104 414/680
6,821,259 B2 * 11/2004 Rahman ..... A61F 5/0102 601/24
6,896,704 B1 * 5/2005 Higuchi ..... A61F 2/583 623/25
7,153,242 B2 * 12/2006 Goffer ..... A61F 5/0102 482/66
7,549,969 B2 * 6/2009 van den Bogert .... A61F 5/0102 602/16
7,628,766 B1 * 12/2009 Kazerooni ..... A61F 5/00 601/35
7,840,309 B2 * 11/2010 Hasegawa ..... B62D 57/032 700/245
8,419,096 B2 * 4/2013 Kim ..... B25J 15/0009 294/106
8,540,748 B2 * 9/2013 Murphy ..... 606/205
8,608,479 B2 * 12/2013 Liu ..... A61H 1/024 434/255
2005/0053453 A1 * 3/2005 Wilson ..... A63H 17/12 414/729
2006/0169086 A1 * 8/2006 Garrec ..... B25J 9/104 74/490.04
2006/0276728 A1 * 12/2006 Ashihara ..... A61F 5/0102 601/5
2007/0135279 A1 * 6/2007 Purdy ..... A63B 21/0004 482/124
2008/0009771 A1 * 1/2008 Perry ..... B25J 9/0006 600/587
2008/0065269 A1 * 3/2008 Hasegawa ..... B62D 57/032 700/260
2008/0288107 A1 * 11/2008 Tokita ..... A61H 1/0237 700/245
2009/0036815 A1 * 2/2009 Ido ..... A61H 1/0237 602/23
2009/0105878 A1 * 4/2009 Nagasaka ..... B25J 13/084 700/245
2009/0105997 A1 * 4/2009 Nagasaka ..... G06F 17/5009 703/2
2009/0272585 A1 * 11/2009 Nagasaka ..... B25J 9/1633 180/8.6
2009/0312867 A1 * 12/2009 Hasegawa ..... B62D 57/032 700/245
2010/0011899 A1 * 1/2010 Kim ..... B25J 9/104 74/490.04
2010/0061835 A1 * 3/2010 Sim ..... B25J 5/00 414/732
2010/0170361 A1 * 7/2010 Bennett ..... A61B 17/32002 74/490.04
2011/0166489 A1 * 7/2011 Angold ..... A61H 1/0255 601/34
2011/0213599 A1 * 9/2011 Jacobsen ..... B25J 9/0006 703/7
2012/0234126 A1 * 9/2012 Gosselin ..... B25J 3/04 74/490.14
2012/0271207 A1 * 10/2012 Schoen ..... A61F 5/0102 601/34
2013/0013111 A1 * 1/2013 Hurst ..... B62D 57/032 700/258
2013/0226048 A1 * 8/2013 Unluhisarcikli ..... A61H 3/00 601/34
2013/0245524 A1 * 9/2013 Schofield ..... A61F 5/0125 602/16
2013/0304084 A1 * 11/2013 Beira ..... A61B 19/2203 606/130
2014/0190289 A1 * 7/2014 Zhu ..... B25J 9/104 74/89.22
2014/0330431 A1 * 11/2014 Hollander ..... B25J 9/0006 700/245

OTHER PUBLICATIONS

Justin Ghan, et al., Control and system identification for the Berkeley lower extremity exoskeleton (BLEEX), Advanced Robotics, 2006, pp. 989-1014, vol. 20, No. 9, VSP, Berkeley, CA, USA.
Kenta Suzuki, et al., Intention-based walking support for paraplegia patients with Robot Suit HAL, Advanced Robotics, 2007, pp. 1441-1469, vol. 21, No. 12, VSP, Tsukuba, JP.

* cited by examiner

MOTION ASSIST DEVICE AND MOTION ASSIST METHOD

BACKGROUND

The technology of the present disclosure relates to a motion assist device, which is worn on a body of a person, mainly an aged person, etc., who desires assistance and nursing care, to physically and psychologically assist motion of the person's body, and to a motion assist method, and particularly relates to a motion assist device and a motion assist method for generally assisting various motions of the person's body including walking motion.

Japan's population aging rate (a proportion of elderly persons aged 65 or over to the total population) was 23.1% in 2010, which is expected to reach 30% in 2025. With such a rapid increase in ratio of elderly persons in the population composition, it has become an urgent task to realize a society where elderly persons can live healthy and actively without falling into a condition of need for long-term care as far as possible, and even if they fell into the condition of need for long-term care, they are prevented from worsening as far as possible and can lead an independent life.

In the face of an aging society, there is a growing demand in nursing homes and households with elderly members for mechatronic devices intended to physically and mentally assist elderly persons. Beyond the physical assistance provided by an autonomous walking assist device, a power assist suit, etc., there is also a demand for mental assistance by an occupational therapy in which a robot is effectively incorporated.

One of the important considerations in the development of assist/nursing-care mechatronic devices is to maintain and promote activities of elderly persons to the extent possible without unnecessary interference. If activities of the elderly persons are excessively performed by the machine just because they have declined in strength, the strength of the elderly persons will further decline, making the situation worse (disuse syndrome). The power assist suit, which is a device that applies an artificial force as assistance to a force generated by human muscles, is a desirable device in that it can maintain activities of the elderly person while supplementing the decreased strength of the elderly person.

However, at present the penetration rate of the power assist suit is still low. The following are the probable reasons.

(1) The power assist suit is troublesome to wear;
(2) It is expensive;
(3) The device is heavy;
(4) It gives support only in an awkward manner;
(5) It looks clumsy when worn; and
(6) The operating time is short.

For example, a force-control-type power assist method, which applies a driving force to joints on the basis of outputs from a myoelectric sensor and estimation results of motion phases, has recently been drawing attention (see e.g., Kawamoto H., Lee S., Kanbe S., Sankai Y.: "Power Assist Method for HAL-3 using EMG-based Feedback Controller", Proc. of Intl Conf. on Systems, Man and Cybernetics (SMC2003), pp. 1648-1653, 2003). However, since as much as nine myoelectric sensors have to be attached to one leg, they are troublesome to wean In addition, the myoelectric sensor can come off the skin due to temporal change or perspiration. Once the contact between the myoelectric sensor and the skin is lost, output values of the myoelectric sensor become unstable, which may cause the power assist suit to go out of control or an improper force to be applied to the body of the person wearing the suit.

Further, there has been proposed a walking assist device which applies a designed torque pattern in accordance with a phase of walking to a person's body while the person is walking (see e.g., Kenta Suzuki, Gouji Mito, Hiroaki Kawamoto, Yasuhisa Hasegawa, Yoshiyuki Sankai: "Intention-Based Walking Support for Paraplegia Patients with Robot Suit HAL", Advanced Robotics, Vol. 21, No. 12, pp. 1441-1169, 2007). However, since users walk in various patterns, there are many cases which are not covered by the designed torque patterns. For this reason, the walking assist device is likely to cause a sense of discomfort during walking or be capable of only unnatural, low speed walking.

On the other hand, there has been also proposed a body assist device which uses no myoelectric sensors (e.g., see J. Chan, R. Steger, Kazerooni, H., "Control and System Identification for the Berkeley Lower Extremity Exoskeleton", Advanced Robotics, Volume 20, Number 9, pp. 989-1011, Number 9, 2006). This device is configured to sense motion of a user's joint and apply a force for supporting the motion to the joint. However, this device unfortunately fails to reflect an intention of the user's motion with high sensitivity in the presence of an obstacle to the motion of the user's joint. For example, viscosity resistance at a gear part included in the joint units of the current power assist suit can cause an obstacle to the motion of the user's joint. Such an obstructive factor has to be eliminated in the future.

Most of the power assist suits which use no myoelectric sensors generate a force on the basis of an empirical rule or an invalid control law. Ideally, the myoelectric sensor can directly reflect an intention of the user's motion (although in reality, as mentioned above, stable sensing is hard to achieve with the myoelectric sensor). On the other hand, it is difficult to extract intentions of the user through sensing of the joint motion. Under these conditions, the present inventors consider that there has to be a valid control law for providing a supportive force without causing stress or a sense of unnaturalness to the user.

For example, there has been proposed a walking assist system which assists forward swing of a leg while supporting balance and a body weight of a user (see e.g., Japanese Patent Laid-Open No. 2011-62163). This walking assist system is constituted of an inverted-pendulum-type moving body for the user to grip and a walking assist device for assisting motion of the user's legs, and is configured such that a predetermined speed relationship is established between a target travelling speed of the inverted-pendulum-type moving body and that of the walking assist device. The inverted-pendulum-type moving body controls the travel on the basis of the target travelling speed and movement of a base body when the user grips the moving body, while the walking assist device transmits a force to the user on the basis of motion of the user's leg and the target travelling speed. Thus, the walking assist system can be considered to be a system which provides rhythm assistance, that is, supports a hip joint in accordance with a phase of walking. However, assistance of the walking assist system is applicable to walking motion and it is not versatile enough to be applied to other motions of the person's body. Additionally, a body weight assist having a saddle at a crotch part has also been proposed, but it gets in the way of sitting down and has an unattractive appearance.

The power assist suit in related art generally includes one actuator for driving of each joint. Accordingly, assisting more joint portions results in increasing the number of the actuators, which causes the device to become heavier, more expensive, and hence less practical. In addition, the high proportion of the actuators in the device restricts the design, so that the device tends to be visually unappealing, and contributes to shorter operating time due to increase of driving power.

SUMMARY

According to an embodiment of the present technology, there is provided an excellent motion assist device, which is worn on a body of a person, mainly an aged person, etc., who wants assistance and nursing care, and which can physically and psychologically assist motion of the person's body in a suitable manner, and a motion assist method.

According to an embodiment of the present technology, there is further provided an excellent motion assist device, which supports a force in a natural manner using a smaller number of actuators relative to a number of joints, while realizing reduction in weight and price, and a motion assist method.

According to an embodiment of the present technology, there is provided a motion assist device including a jth link worn on a jth portion of a user, an ith joint unit connected at one end of an ith link in a freely rotatable manner, a (j+1)th link worn on a (j+1)th portion of the user, an (i+1)th joint unit integral with one end of the (j+1)th link and coupled to the other end of the jth link, a single actuator installed at one of the jth link and a link adjacent to the jth link, and a transmission part transmitting a driving force of the actuator to the ith joint unit and the (j+1)th joint unit.

According to an embodiment of the present technology, the transmission part may transmit the driving force of the actuator in a manner that a proportional relationship is established between a torque generated at the ith joint unit and a torque generated at the (i+1)th joint unit.

According to an embodiment of the present technology, the transmission part may transmit the driving force of the actuator in a manner that driving directions of the ith joint unit and the (i+1)th joint unit are opposite to each other.

According to an embodiment of the present technology, the transmission part may transmit the driving force of the actuator to the ith joint unit and the (i+1)th joint unit through a wire, According to an embodiment of the present technology, the transmission part constituted of the wire may be crossed between the ith joint unit and the (i+1)th joint unit.

According to an embodiment of the present technology the jth link may be a thigh link worn on a thigh part of a leg of the user. The ith joint unit may be a hip pitch joint connected at an upper end of the thigh link in a freely rotatable manner. The (j+1)th link may be a shank link worn on a shank part of the leg. The (i+1)th joint unit may be a knee pitch joint integral with an upper end of the shank link and coupled to a lower end of the thigh link. The actuator may be installed at the thigh link.

According to an embodiment of the present technology; the transmission part may include a wire which is wound around an output axis of the actuator, thereafter wound around the hip pitch joint in a same direction as a rotation direction of the actuator, and then wound around the knee pitch joint in an opposite direction to the rotation direction of the actuator.

According to an embodiment of the present technology, the jth link may be a thigh link worn on a thigh part of a leg of the user. The ith joint unit may be a knee pitch joint connected at a lower end of the thigh link in a freely rotatable manner. The (j+1)th link may be a pelvis link worn on the thigh part of the leg. The (i+1)th joint unit may be a hip pitch joint integral with the pelvis link and coupled to an upper end of the thigh link. The actuator may be installed at a shank link adjacent to the thigh link.

According to an embodiment of the present technology, the transmission part may include a wire which is wound around an output axis of the actuator, thereafter wound around the knee pitch joint in a same direction as a rotation direction of the actuator, and then wound around the hip pitch joint in an opposite direction to the rotation direction of the actuator.

According to an embodiment of the present technology, the motion assist device may further include a target torque determining part determining a torque target value of the actuator, and an actuator control part which controls the actuator by torque control on the basis of the torque target value.

According to an embodiment of the present technology, the motion assist device may further include a joint angle measuring part which measures a joint angle of the joint unit, and a torque measuring part which measures an external torque acting on the actuator. The actuator control part may control the actuator by torque control in a manner that a desired relationship is established between the joint angle measured by the joint angle measuring part and the external torque measured by the torque measuring part.

According to an embodiment of the present technology, the actuator control part may include a disturbance observer which calculates a disturbance torque $\tau_d$ at a time when the actuator is driven with a target torque $\tau_A$. A joint angular acceleration target value may be obtained from an ideal response model of the actuator, in which the joint angular acceleration target value, which is achieved by the actuator responding on the basis of the target torque $\tau_A$, an external torque $\tau_e$, and a joint angle speed obtained by differentiating the joint angle by time, is calculated and output. The actuator control part may determine a command torque $\tau$ for the actuator in a current control period, by correcting a torque target value $\tau^{ref}$, which is obtained by multiplying the joint angular acceleration target value by an inertia nominal value $J_n$ in the actuator, with the disturbance torque $\tau_d$, which is obtained by the disturbance observer in a previous control period.

According to an embodiment of the present technology, the motion assist device may further include a state detecting part which detects whether the leg is in a state of standing leg or an idling leg, a joint angle measuring part which measures joint angles of the hip pitch joint and the knee pitch joint, and a target torque determining part which determines the torque target value based on the joint angle of the hip pitch joint or the knee pitch joint depending on whether the leg is in the state of the standing leg or the idling leg. The actuator control part controls the actuator by torque control on the basis of the torque target value.

According to an embodiment of the present technology, the target torque determining part may determine the torque target value on the basis of the joint angle of the knee pitch joint when the leg is the standing leg, and determines the torque target value based on the joint angle of the hip pitch joint when the leg is the idling leg.

According to an embodiment of the present technology, the state detecting part may include a contact switch which determines whether or not a foot part of the leg is grounded.

According to an embodiment of the present technology, a motion assist method is for assisting motion of the user using the motion assist device, and includes detecting whether the leg is in a state of the standing leg or the idling leg, measuring joint angles of the hip pitch joint and the knee pitch joint, determining the torque target value based on the joint angle of the hip pitch joint or the knee pitch joint depending on whether the leg is in the state of the standing leg or the idling leg, and controlling the actuator by torque control on the basis of the torque target value.

According to the technology of the present disclosure, it is possible to provide the excellent motion assist device, which is configured to apply a force to the multiple joints by one actuator and thereby realizes reduction in weight and price, and the motion assist method.

Further, according to the technology of the present disclosure, it is possible to provide the excellent motion assist device, which can drive both the hip joint and the knee joint by one actuator by performing wire-coupled driving such that a certain relationship is established particularly between the hip joint and the knee joint, and which can realize reduction in weight and price without sacrificing natural manner of providing a supportive force by producing effects for supporting weight of the standing leg as well as for pulling up the idling leg, and the motion assist method.

Since a power assist suit to which the technology of the present disclosure is applied has a lower proportion of the actuator in the device, design for visual appeal is facilitated, and due to saving on the driving power for the actuator, the operating time can be increased.

Other purposes, features, and advantages of the technology of the present disclosure will be clarified by a detailed description based on the following embodiments and appended drawings.

DETAILED DESCRIPTION OF THE EMBODIMENT(S)

Figure 1:
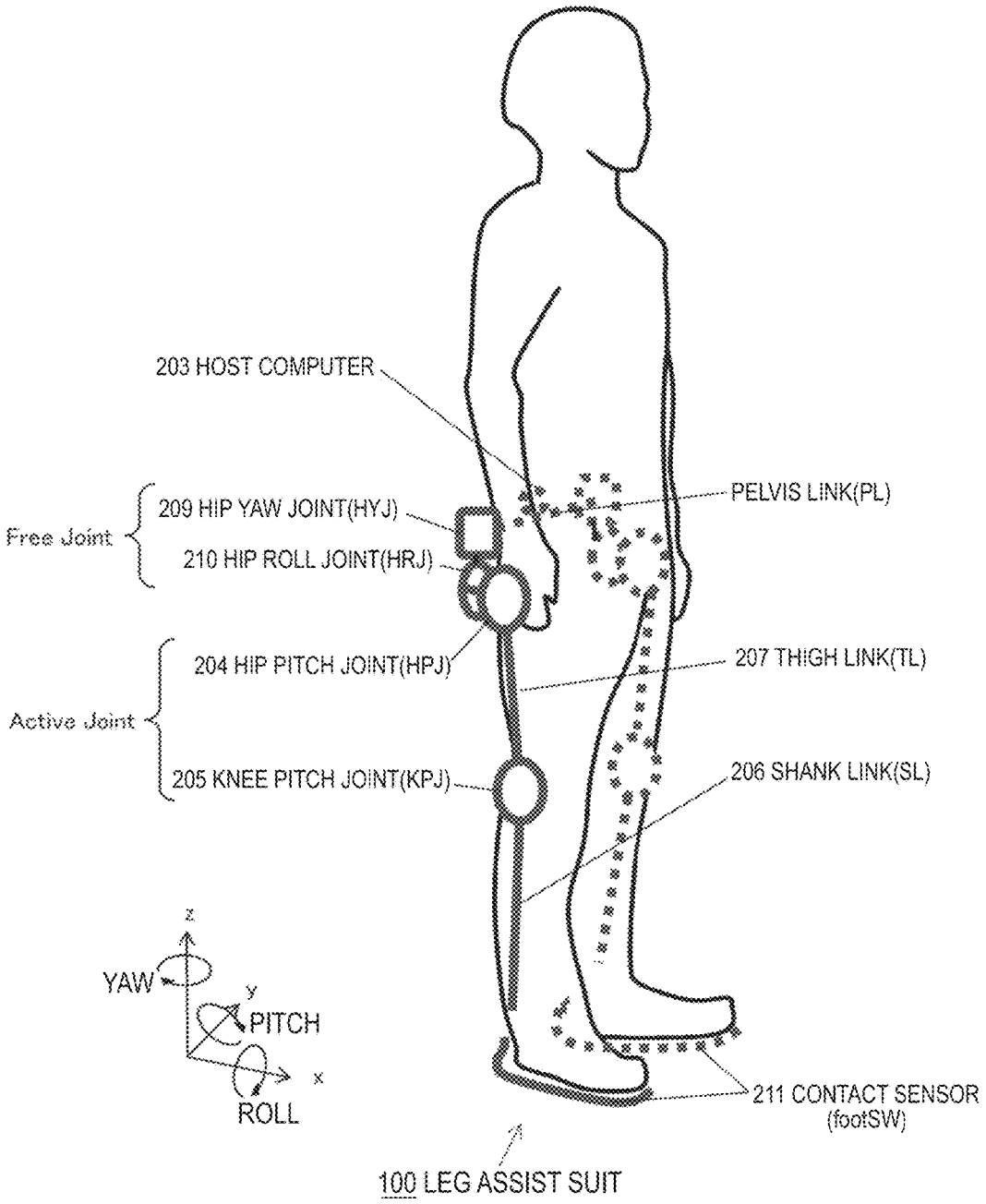
FIG. 1 is a schematic view showing a configuration of a leg assist suit 100 to which e technology of the present disclosure is applied.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

FIG. 1 is a schematic view showing a configuration of a leg assist suit 100 to which the technology of the present disclosure is applied.

The illustrated leg assist suit 100 has total eight degrees of freedom: three degrees of freedom, roll, pitch, and yaw at a hip joint, and one degree of freedom, pitch at a knee joint, for each of left and right legs of a person's body. In FIG. 1, joint units and links on the right side of the body are depicted with a solid line on the near side of the figure, while the joint units and the links on the left side of the body behind the right leg are depicted with a dotted line on the far side of the figure.

The joints are connected to each other by a rigid link. Specifically, left and right hip joints are connected by a pelvis link (PL) 208; the hip joint and a knee joint on each of the left and right sides are connected by a thigh link (TL) 207; and the knee joint and an ankle joint on each of the left and right sides are connected by a shank link (SL) 206. The pelvis link (PL) 208, the thigh link 207, and the shank link 206 are each fixed to the person's body by a band (not shown).

The leg assist suit 100 illustrated has, in each of the left and right legs, four degrees of joint freedom of a hip yaw joint (HYJ) 209, a hip roll joint (HRJ) 210, a hip pitch joint (HPJ) 204, and a knee pitch joint (KPJ) 205. Of these joints, only the hip pitch joint 204 and the knee pitch joint 205 are active joints which generate a driving force, and the other hip yaw joint 209 and the hip roll joint 210 are free joints which do not generate a force. In addition, the ankle joint is only fixed by the band and there is no freedom at the ankle joint.

A host computer 203 which controls the leg assist suit 100 is mounted on the pelvis part. Contact sensors (footSW) 211 for detecting a grounded state between a foot bottom and a road surface are mounted on the left and right foot bottom parts, and whether each of the left and right legs is in a state of a standing leg or an idling leg can be determined on the basis of outputs of the contact sensor 211.

Figure 2:
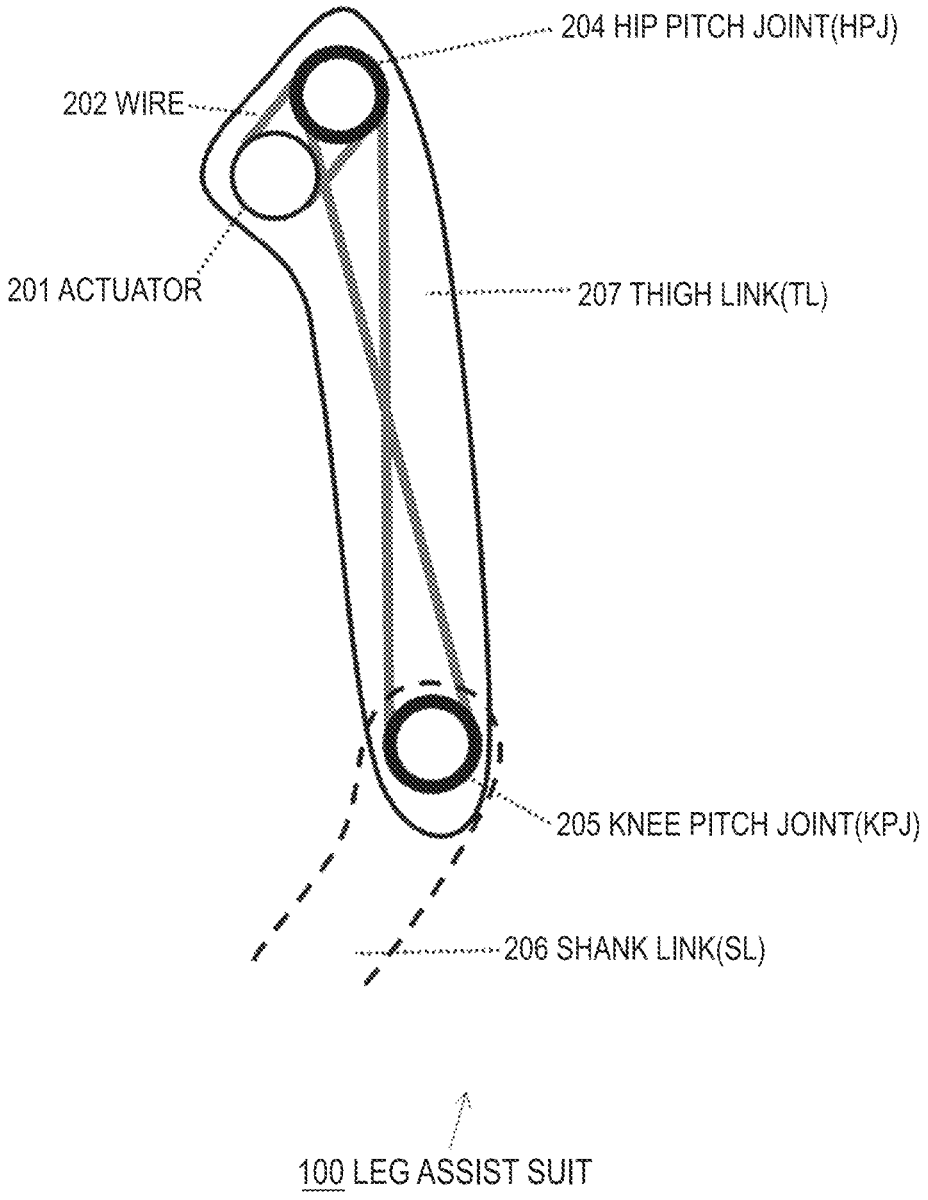
FIG. 2 is an enlarged view around a hip joint and a knee joint of the leg assist suit shown in FIG. 1 (an example configuration where an actuator 201 is installed at a thigh link 207)

FIG. 2 is an enlarged view around the hip joint and the knee joint of the leg assist suit 100 shown in FIG. 1. As illustrated, the hip pitch joint 204 and the knee pitch joint 205 on each of the left and right sides are the active joints, and these joints are driven by one actuator 201. This actuator 201 is installed at the thigh link 207, and outputs thereof are transmitted through a wire 202 to the hip pitch joint 204 and the knee pitch joint 205. Although the actuator is not provided at the left and right knee pitch joints 205, an encoder (not shown in FIG. 2) which measures a joint angle $\theta_{knee}$ of the knee pitch joint 205 is separately mounted on the knee pitch joints.

In the example shown in FIG. 2, the wire 202 is wound around an output axis of the actuator 201, thereafter wound around the hip pitch joint 204 in the same direction as a rotation direction of the actuator 201, namely in a regular direction, and then wound around the knee pitch joint 205 in an opposite direction to the rotation direction of the actuator 201, namely in a non-regular direction. The wire 202 is crossed between the hip pitch joint 204 and the knee pitch joint 205.

The knee pitch joint 205 is fixed to the shank link 206. Specifically, a pulley of the knee pitch joint 205 is formed integrally with the shank link 206. Thus, when rotation of the output axis of the actuator 201 is transmitted through the wire 202 to the knee pitch joint 205, the shank link 206 operates integrally with the knee pitch joint 205.

On the other hand, the hip pitch joint 204 is freely attached to the thigh link 207. Specifically, a pulley of the hip pitch joint 204 is not integral with the thigh link 207 but freely rotatable through a bearing (not shown). Thus, rotation of the output axis of the actuator 201 alone does not cause the thigh link 207 to be operated through the pulley of the hip pitch joint 204, and a torque $\tau_{hip}$ is not generated at the hip pitch joint 204.

Here, when a torque $\tau_{knee}$ is generated at the knee pitch joint 205, which is integral with the shank link 206, by an external force applied to the ankle, etc., a coupled torque $\tau_{hip}$ is generated at the hip pitch joint 204 due to the coupled driving through the wire 202 (see K. Yokoi et W. "Design and Control of a Seven-Degrees-of-Freedom Manipulator Actuated by a Coupled Tendon-Driven System", In Proc. Annual Conf. of Robotics Society of Japan, 1991, pp. 461-464). As described later, a proportional relationship is established between the torque $\tau_{hip}$ generated at the hip pitch joint 204 and the torque $\tau_{knee}$ generated at the knee pitch joint 205.

Thus, since there is a restraining relationship through wire-coupled driving between the hip pitch joint 204 and the knee pitch joint 205, the knee part and the thigh part of the leg assist suit 100 can be simultaneously operated using the single actuator 201 alone.

Figure 3:
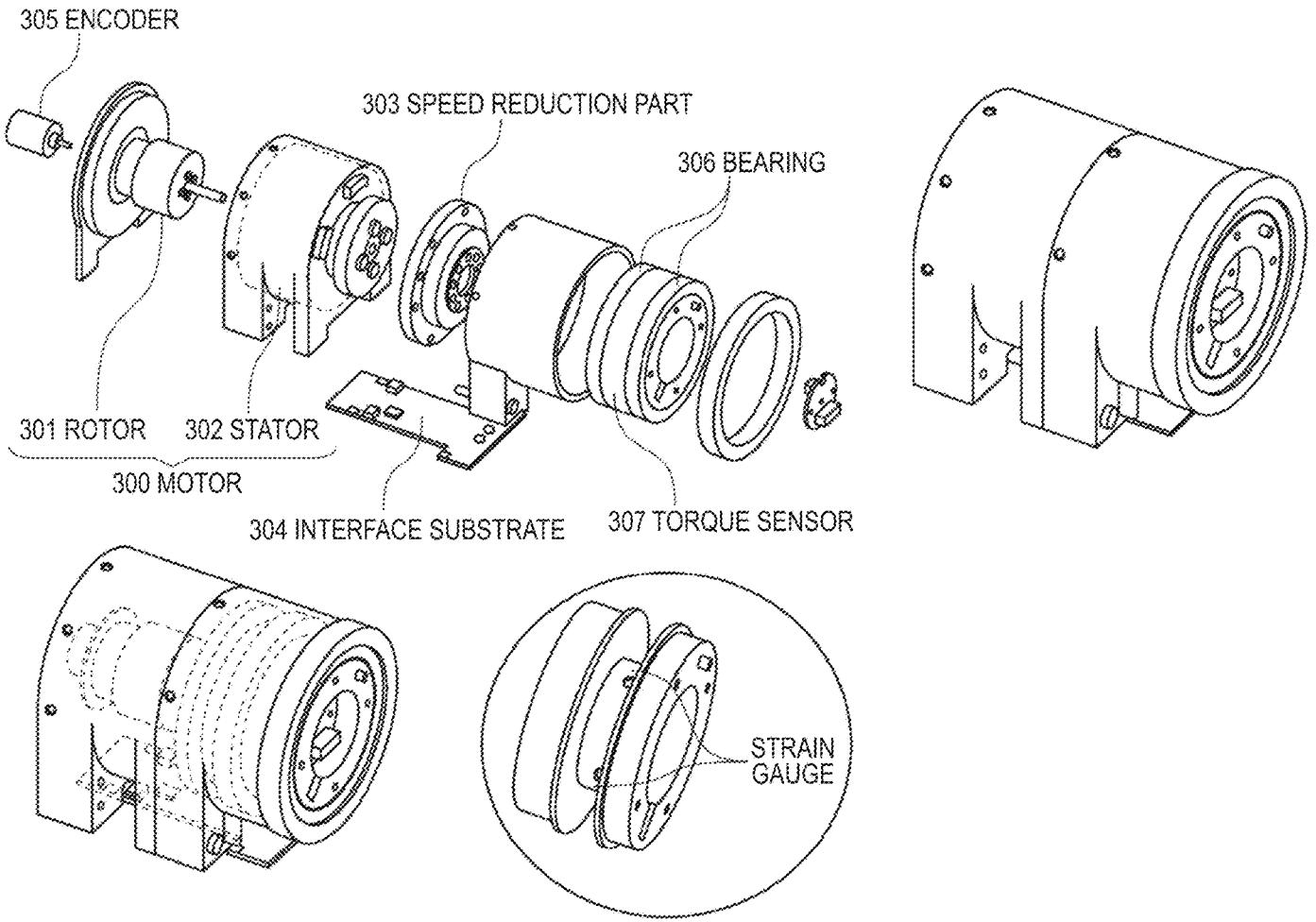
FIG. 3 is a view showing an example configuration of an actuator (A) which is applied to joint driving of the leg assist suit shown in FIG. 1.

FIG. 3 shows an example configuration of the actuator 201 which is applied to simultaneous driving of the hip pitch joint 204 and the knee pitch joint 205 of the leg assist suit 100 shown in FIG. 1. The actuator 201 illustrated includes a motor 300 main body constituted of a rotor 301 and a stator 302, and a speed reduction part 303 constituted of a gear such as a wave gear device, and the actuator is mounted on an interface substrate 304. An encoder 305 which detects rotational positions, namely angles of the joints, is attached to the rotor of the motor. In addition, a link of a subsequent stage (not shown) is connected through a bearing 306 to the output axis of the speed reduction part, and a torque sensor 307 for detecting an output torque is attached to the output axis.

The hip pitch joint 204 has the wire 202 wound around it same direction as the rotation direction of the actuator 201. Thus, a joint angle $\theta_{hip}$ of the hip pitch joint 204 can be measured by the output of the encoder 305 inside the actuator 201. In addition, the joint angle $\theta_{knee}$ of the knee pitch joint 205 can be measured by the (above-mentioned) encoder which is separately attached to the knee pitch joint 205.

Figure 4:
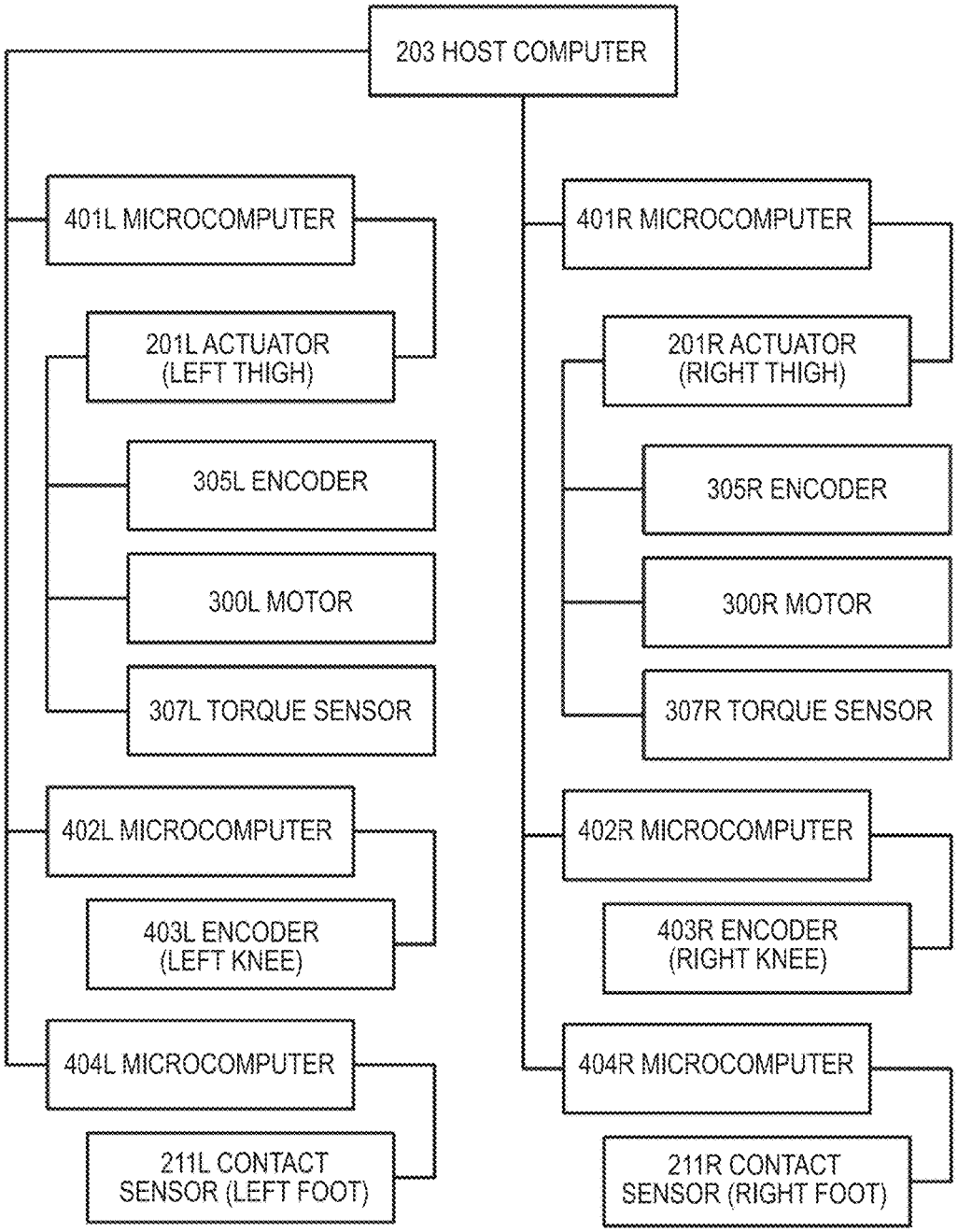
FIG. 4 is a diagram of an example configuration of a control system of the leg assist suit 100 which is built around a host computer 203.

FIG. 4 shows an example configuration of a control system for the leg assist suit 100 which is built around the host computer 203 mounted on the pelvis part of the leg assist suit 100. Actuators 201L/R respectively provided on the left and the right sides are provided with microcomputers 401L/R for performing torque control and communication with the host computer 203. The host computer 203 can give a torque control target value to the motor 300 inside the actuator 201 through the microcomputers 401L/R. Further, the host computer 203 can read out detected values of encoders 305L/R and torque sensors 307L/R included in the actuator 201L/R through the microcomputers 401L/R. In addition, encoders 403L/R at the left and right knee joints are provided with microcomputers 402L/R, respectively, and contact sensors 211L/R mounted on the left and right foot bottoms are also provided with microcomputers 404L/R, respectively. The host computer 203 can read out outputs of the encoders 403L/R and the contact sensors 211L/R of the left and right feet through the microcomputers 402L/R and 404L/R by similar communication.

The host computer 203 can obtain the joint angle $\theta_{hip}$ of the hip pitch joint from the output value of the encoders 305L/R inside the actuator 201L/R, and can obtain the joint angle $\theta_{knee}$ of the knee pitch joint from the output value of the encoders 403L/R at the knee joint.

In the present embodiment, the host computer 203 adopts not a position control method but a force control method for the actuator 201, and performs force control, without using myoelectric sensors, on the basis of the joint angle $\theta_{hip}$ of the hip pitch joint 204 and the joint angle $\theta_{knee}$ of the knee pitch joint 205 which are equivalent to motion of the user's joints. Thus, the user is relieved of the trouble of wearing the myoelectric sensors onto the body, and freed from the danger of malfunction based on instability of output values of the myoelectric sensor.

These joint units involve factors such as friction and inertia which cause large errors and are difficult to model or identify. Therefore, in order to realize an ideal joint unit (IJU), such an actuator control device is used for driving the actuator 201 that can deal with disturbance factors existing at the joint units such as friction and inertia, which are difficult to model or identify, and can instruct an output torque on the basis of a mathematical model (ideal response model). Specifically, precise response based on the mathematical model is realized by controlling the actuator 201 using the values of the torque sensor 307 and the outputs of the encoder 305 (see e.g., Japanese Patent No. 4715863). The actuator 201 shows precise secondary-system response, which is governed by specified inertia and viscosity resistance, to the command torque and the external torque. This prevents the motion of the joints from being hindered by friction in the gear of the speed reduction part, etc., and allows even a slight force acting on the joint to be precisely represented as a change in angular acceleration of the actuator 201. Thus, the precise response based on the mathematical model can be realized by controlling by means of the output torque obtained by the torque sensor 307 and the angle detected by the encoder 305. Accordingly, it is possible to generate a force for supporting motion of the user wearing the leg assist suit 100 without causing resistance to the joint of the user.

Assuming that mass properties of the leg assist suit 100 shown in FIG. 1 and the person wearing it are known, when a system combining the person and the leg assist suit is modeled as a two-legged robot, the actuator 201 in its dynamics operation is modeled by the following Expression (1).

$$I_a\ddot{q}_A=\tau_A-\tau_e-v_a\dot{q}_A \tag{1}$$

In the above Expression (1), $I_a$ denotes a virtual inertia; $q_A$ denotes a joint angle of the joint (equivalent to $\theta_{hip}$ and $\theta_{knee}$ obtained as the outputs of the encoder); $\tau_A$ denotes a torque target value which is a command value of a torque generated at the joint; $\tau_e$ denotes an external torque acting on the joint; and $v_a$ denotes a virtual viscosity coefficient inside the joint (unknown and difficult to model). A calculation method of the torque target value $\tau_A$ will be described later.

Expression (1) shows that the ideal model includes the external torque term $\tau_e$ acting on the joint. Thus, in order to correct the response of the actuator 201 to follow the ideal model, this external torque $\tau_e$ is desired to be detected. In the present embodiment, as described above, the actuator 201 is provided with the torque sensor 307 (see FIG. 3) for measuring the external torque $\tau_e$ at the output axis of the speed reduction part 303, and the torque measurement results are collected in the host computer 203.

That the actuator 201 responds in accordance with the ideal model represented by the above Expression (1) means exactly that, when the right side of the above Expression (1) is given, the joint angular acceleration on the left side is achieved. By applying a disturbance observer, which estimates the disturbance torque, to the configuration of such a control system for joint angular acceleration, the joint torque $\tau$ can be determined with high accuracy on the basis of the ideal response model.

Figure 10:
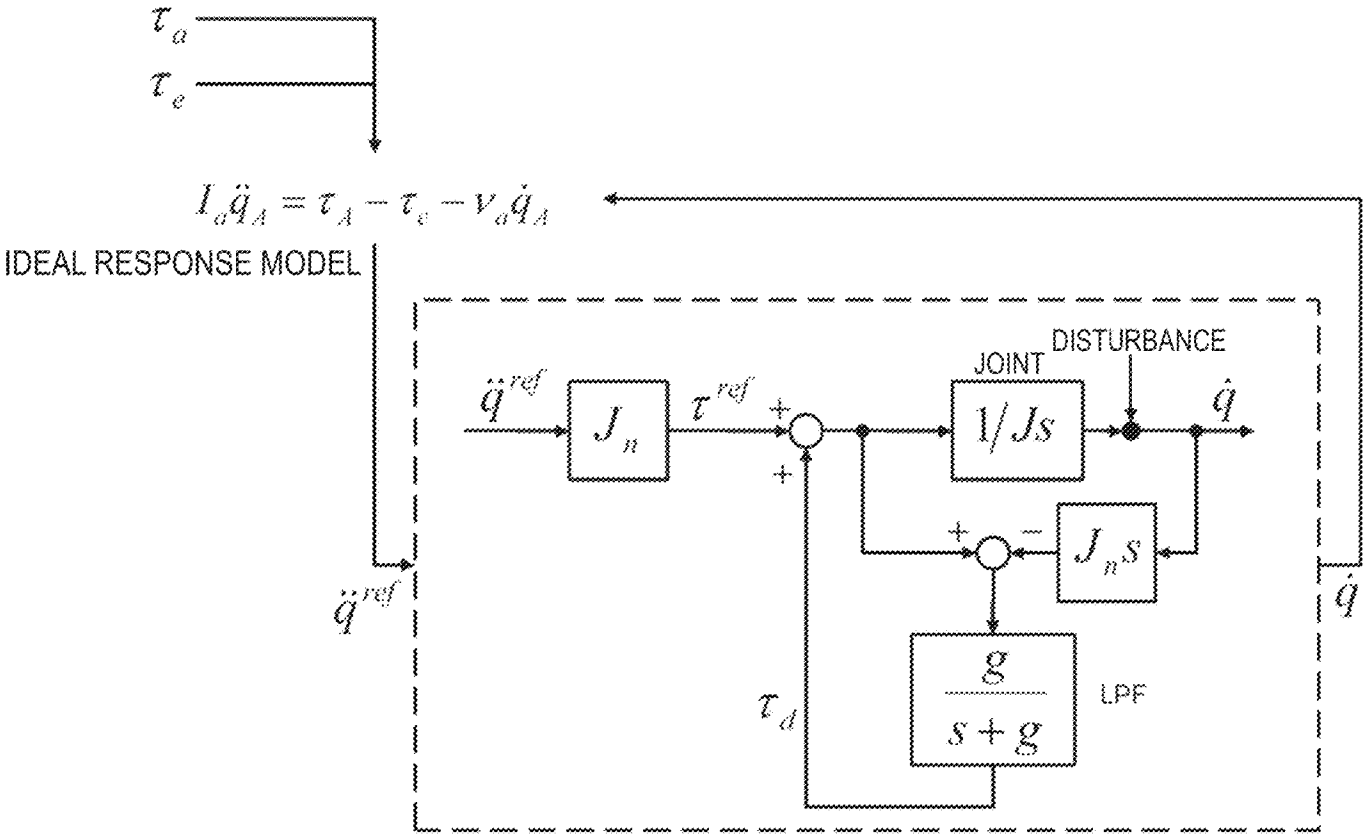
FIG. 10 is a control block diagram for realizing an ideal response of the actuator 201.

FIG. 10 shows a control block diagram for realizing the ideal response of the actuator 201. In the same figure, a portion enclosed by the dotted line corresponds to the disturbance observer, which estimates the disturbance torque $\tau_d$ and eliminates its influence on the control system, thereby establishing a robust acceleration control system. Here, $J_n$ denotes a nominal value of inertia in the joint; J denotes an (unknown) actual value of the inertia in the joint; and $q_A$ denotes the joint angle. In addition, the virtual inertia $I_a$ of the joint is given a virtual constant number as a design matter in the dynamics operation.

In the host computer 203, the target torque $\tau_A$ which is the command value to the actuator 201 is determined for each control period by the force control method, and the external torque actual measurement value $\tau_e$ measured by the torque sensor 307 attached to the output axis of the speed reduction part 303 of the actuator 201, and an angle speed actual measurement value obtained from the joint angle $q_A$ measured by the encoder 305, etc., are sent from the microcomputer 401 provided in the actuator 201 to the host computer 203. Then, these target torque $\tau_A$, an external torque actual measurement value $\tau_e$, and the angle speed actual measurement value of the joint angle $q_A$ are substituted into the ideal response model represented by the above Expression (1) to obtain the acceleration target value for the joint angle $q_A$ on the left side of the same expression, and this angular acceleration target value is input to the disturbance observer.

In the disturbance observer, the input acceleration target value of the joint angle $q_A$ is multiplied by the virtual inertia nominal value $J_n$ of the joint, and converted into a torque target value $\tau^{ref}$ for the current control period. Then, the torque target value $\tau^{ref}$ is corrected with the disturbance torque $\tau_d$, which is obtained by the disturbance observer in a previous control period, to obtain the torque command value $\tau$ for the joint in the current control period.

When force control constituted of the torque command value $\tau$ is applied to the joint having a transfer function $1/J_n$, the joint is rotary driven under the influence of the disturbance such as friction and inertia existing in the joint unit. Specifically, the torque command value $\tau$ is converted into a current command value, which becomes an instruction input to a driving circuit of the motor 300. The torque $\tau_e$ generated at this time and the joint angle $q_A$ are measured by the torque sensor 307 and the encoder 305, etc., respectively, and the joint angle output $q_A$ is differentiated by time to obtain the joint angle speed.

The disturbance observer can estimate the torque which has acted on the joint by applying a transfer function $J_n s$ constituted of the virtual inertia nominal value $J_n$ of the joint to the measured angle speed of the joint angle $q_A$, and can estimate the disturbance torque $\tau_d$ by subtracting this estimated torque from the torque command value $\tau$ for the joint. Then, the disturbance torque $\tau_d$ obtained in the current control period is fed back and used for correction of the torque command value $\tau$ in the next control period. The purpose of a low-pass filter (LPF) represented by g/(s+g) and inserted in the middle is to prevent the system from diverging.

In this way, even when disturbance components such as friction and inertia which are not able to be modeled exist in the joint unit, it is possible to have the acceleration response of the actuator to follow the acceleration target value. That is, since the joint angular acceleration on the left side of the above Expression (1) can be achieved when the right side is given, the actuator can respond in accordance with the ideal model despite being subjected to the influence of the disturbance. However, the disturbance observer is not suitable for elimination of disturbance in a high-frequency region, since the above-described low-pass filter g/(s+g) is inserted in the middle of the feedback of the disturbance torque $\tau_d$ (as described above).

The disturbance observer estimates the disturbance components in a plant and feeds back to a control input, thereby allowing a target condition to be reached even in the presence of an unknown parameter fluctuation and disturbance in the plant. However, in order to correctly estimate the disturbance, the feedback operation is desired to be repeated over multiple cycles.

In the control block configuration shown in FIG. 10, the disturbance observer obtains the angular acceleration of the joint angle $q_A$ from the above Expression (1), and sets it as the joint angular acceleration target value for the actuator of the joint unit. The angular acceleration of the joint angle q is determined on the basis of the external torque $\tau_e$ obtained from the torque sensor 307, the target torque $\tau_A$ for the joint, and the time differentiation of the joint angle $q_A$ output from the encoder 305, etc. Due to such a configuration, the joint unit can respond in accordance with the inertia $I_a$ and the viscosity coefficient $v_a$, and thereby idealized.

As described above, the wire 202 is wound around the output axis of the actuator 201, thereafter wound around the hip pitch joint 204 in the same direction as the rotation direction of the actuator 201, and then wound around the knee pitch joint 205 in the opposite direction to the rotation direction of the actuator 201 (see FIG. 2). Due to coupled driving through this wire 202, a torque as represented by the following Expression (2) is generated at each joint of the leg assist suit 100 (see. e.g., K. Yokoi et al., pp. 461-464).

$$\tau_i = \Sigma s_{ij} r_{ij} f_j \tag{2}$$

In the above Expression (2), $\tau_i$ denotes a torque generated at an ith joint, and $f_j$ denotes a tensile force generated in a jth wire. The jth wire is wound around the ith joint by a pulley having a radius $r_{ij}$. In addition, $s_{ij}$ indicates a direction in which the jth wire is wound around the pulley of the ith joint, with a plus or a minus sign. If the pulley rotates in a regular direction of the angle of the joint on which the tensile force $f_j$ acts, $s_{ij}$ has a value +1, and if the pulley rotates in the opposite direction, $s_{ij}$ has a value −1.

An end of the jth wire is connected through a pulley having a radius $R_j$ to the actuator which generates a torque $\tau_j$ represented by the following Expression (3).

$$\tau_j = f_j R_j \tag{3}$$

By the above Expressions (2) and (3), the torque generated at the ith joint is represented by the following Expression (4).

$$\tau_i=\Sigma s_{ij}r_{ij}/R_j\tau_j \quad (4)$$

Here, assuming that all the pulleys have equal radii, when applying the above Expression (4) to the example shown in FIG. 1, the torque $\tau_{hip}$ and $\tau_{knee}$ as shown in the following Expressions (5) and (6) are generated at the hip joint and the knee joint, respectively.

$$\tau_{hip}\times 1.0\times\tau_A \quad (5)$$

$$\tau_{knee}=-1.0\times\tau_A \quad (6)$$

In the above Expressions (5) and (6), $\tau_A$ denotes a torque generated by the actuator 201 provided in the thigh part. The above Expressions (5) and (6) show that the torque generated by wire-coupled driving at the hip pitch joint 204 and the knee pitch joint 205 is equal in magnitude but opposite in direction. If the radii of the pulleys of the hip pitch joint 204 and the knee pitch joint 205 are not equal, the torque $\tau_{hip}$ and $\tau_{knee}$ are not equal in magnitude, but the torque is generated in the opposite direction at a constant ratio according to the ratio of the radii of the pulleys.

In the leg on (he standing leg side of the leg assist suit 100, the knee pitch joint 205 operates so as to extend the thigh link 207 and the shank link 206 (see reference numeral 501 in FIG. 5), and pushes up the user's body weight, which plays an important role in climbing up stairs, for example. It is preferable that, at the same time with this, the hip pitch joint 204 operates so as to extend the thigh link 207 with respect to the user's trunk (see reference numeral 502 in FIG. 5) and maintains the posture of an upper body. In this case, the knee pitch joint 205 operates in the clockwise direction on the plane of FIG. 5, while the hip pitch joint 204 operates conversely in the counterclockwise direction. Thus, in the state of the standing leg, the hip pitch joint 204 and the knee pitch joint 205 are in a cooperative relationship.

On the other hand, in the leg on the idling leg side, the hip pitch joint 204 operates so as to bend the thigh link 207 with respect to the user's trunk (see reference numeral 503 in FIG. 5), and pulls up the user's idling leg. It is preferable that, at the same time with this, the knee pitch joint 205 operates so as to bend the thigh link 207 and the shank link 206 (see reference numeral 504 in FIG. 5) so as to prevent a toe of the idling leg from hitting against the ground. In this case, the hip pitch joint 204 operates in the clockwise direction on the plane of FIG. 5, while the knee pitch joint 205 operates conversely in the counterclockwise direction. Thus, in the state of the idling leg, the knee pitch joint 205 and the hip pitch joint 204 are in a cooperative relationship.

Figure 6:
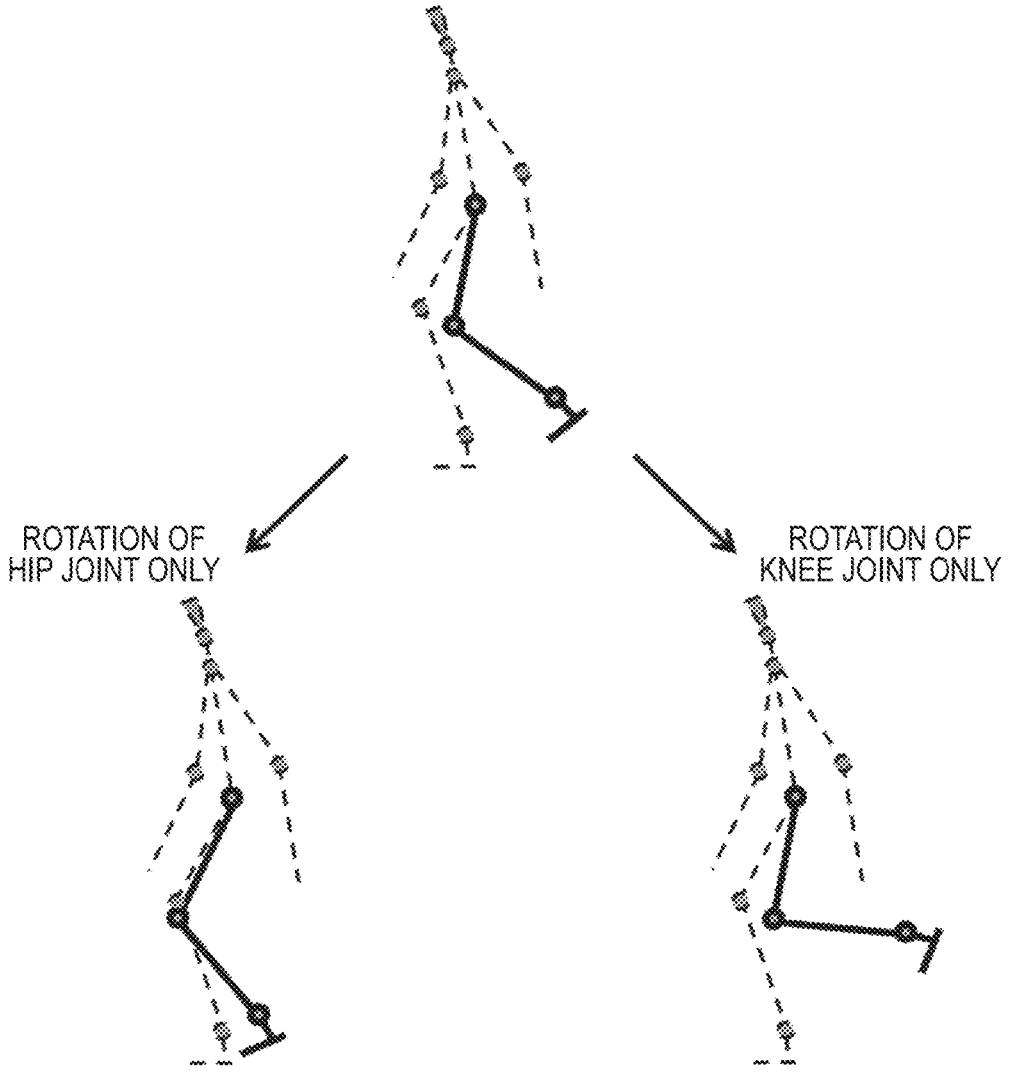
FIG. 6 is a view showing a state where the leg assist suit 100 shown in FIG. 1 generates the supporting force to the legs on the standing leg side and the idling leg side.

Even though the hip pitch joint 204 and the knee pitch joint 205 are in a cooperative relationship, it is necessary to configure the hip pitch joint 204 and the knee pitch joint 205 such that the angle of the hip pitch joint 204 and the knee pitch joint 205 can be independently changed so as to allow the idling leg (and the standing leg) to take any posture according to the user's intention (e.g., as shown in FIG. 6, to operate the hip pitch joint only or operate the knee pitch joint only).

Figure 5:
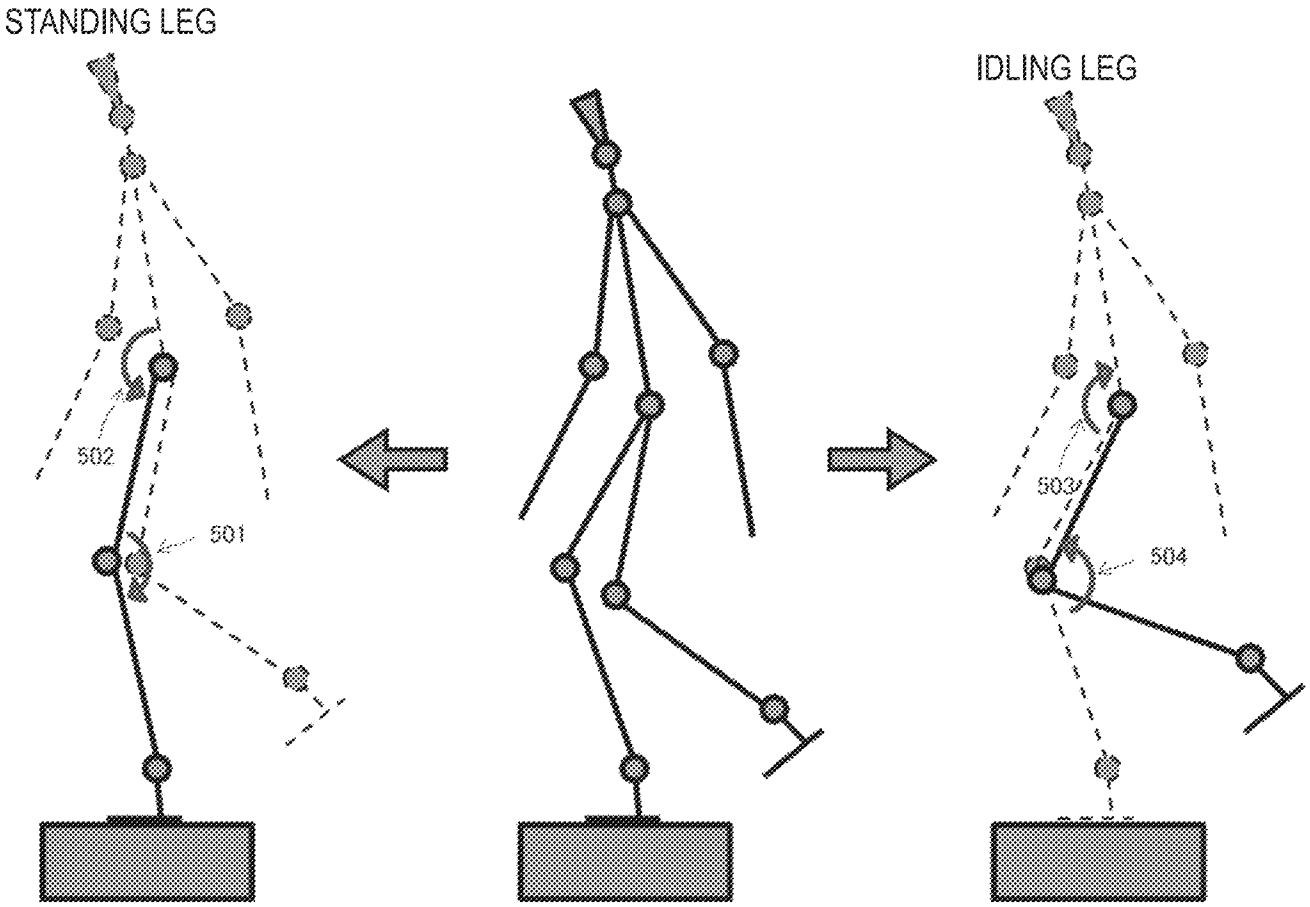
FIG. 5 is a view showing a state where the leg assist suit 100 shown in FIG. 1 generates a supporting force to legs on a standing leg side and an idling leg side.

Due to the configuration as shown in FIG. 1, even though the driving source is only one actuator 201, the leg assist suit 100 can coordinate the two joints of the hip joint and the knee joint by torque control and coupled driving through the wire 202, while allowing the joint angle to be changed independently. That is, as shown in FIG. 5, the leg assist suit 100 can generate a supportive force for pushing up the body weight in the leg part on the standing leg side, and generate a supportive force for pulling up the leg in the leg part on the idling leg side. In FIG. 5, the direction of torque generation indicates a direction of the torque acting from the link on a lower limb base (pelvis) side to the link on a lower limb end (foot bottom) side.

Figure 7:
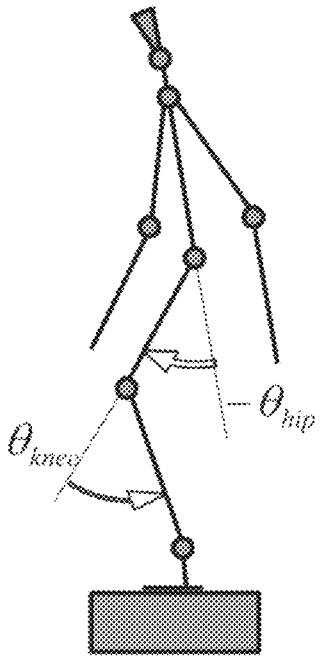
FIG. 7 is a view showing a bending/stretching angle $\theta_{knee}$ of the knee joint on the standing leg side and a bending angle $\theta_{hip}$ of the hip joint on the idling leg side.

In the leg on the standing leg side, from a viewpoint of pushing up the user's body weight, the knee pitch joint 205 assumes more important role. In addition, in the leg on the idling leg side, from a viewpoint of pulling up the leg part, the hip pitch joint 204 assumes more important role. Therefore, as a possible force support law, a method such as the following can be considered: for the standing leg side, generating the torque $\tau_A$ of the actuator 201 according to the bending/stretching angle $\theta_{knee}$ of the knee joint (see the following Expression (7)), and for the idling leg side, generating the torque $\tau_A$ of the actuator 201 according to the bending angle $\theta_{hip}$ of the hip joint (see the following Expression (8)). The bending/stretching angle $\theta_{knee}$ of the knee joint on the standing leg side and the bending angle $\theta_{hip}$ of the hip joint on the idling leg side are. as shown in FIG. 7.

$$\text{(Standing leg side) } \tau_A=K_{p1}(\theta_{knee}) \quad (7)$$

$$\text{(Idling leg side) } \tau_A=K_{p2}(\theta_{hip}) \quad (8)$$

FIG. 2 shows the example configuration where the single actuator 201 is installed at the thigh link 207 and the two joints of the hip pitch joint 204 and the knee pitch joint 205 are coupled-driven through the wire. In this example configuration, the wire 202 is wound around the hip pitch joint 204 in the same direction with the rotation direction of the output axis of the actuator 201, and wound around the knee pitch joint 205 in the opposite direction to the rotation direction of the output axis of the actuator 201, and the pulley of the knee pitch joint 205 is integral with the shank link 206, while the pulley of the hip pitch joint 204 is freely rotatable with respect to the thigh link 207.

By contrast, it is also possible to configure the leg assist suit 100 with the single actuator 201 installed at the shank link 206 instead of at the thigh link 207. In the example shown in FIG. 8, the wire 202 is wound around the output axis of the actuator 201 installed at the shank link 206, thereafter wound around the knee pitch joint 205 in the same direction with the rotation direction of the actuator 201, namely in the regular direction, and then wound around the hip pitch joint 204 in the opposite direction to the rotation direction of the actuator 201, namely in the non-regular direction. The wire 202 is crossed between the knee pitch joint 205 and the hip pitch joint 204.

The hip pitch joint 204 is fixed to the pelvis link 208. Specifically, the pulley of the hip pitch joint 204 is formed integrally with the pelvis link 208. Thus, when the rotation of the output axis of the actuator 201 is transmitted through the wire 202 to the hip pitch joint 204, the thigh link 207 is operated with respect to the pelvis link 208.

On the other hand, with respect to both the shank link 206 and the thigh link 207, the knee pitch joint 205 is integral with neither of the free shank link 206 and thigh link 207 but freely rotatable through a bearing (not shown). Thus, the rotation of the output axis of the actuator 201 alone does not cause the shank link 206 to be operated through the pulley of the knee pitch joint 205, and the torque $\tau_{knee}$ is not generated at the knee pitch joint 205.

Here, when the torque $\tau_{hip}$ is generated at the hip pitch joint 204, which is integral with the pelvis link 208, by an external force applied to the pelvis link 208, etc., the coupled torque $\tau_{knee}$ is generated at the knee pitch joint 205 due to the coupled driving through the wire 202 (same as above). As already described, a proportional relationship is established between the torque $\tau_{hip}$ generated at the hip pitch joint 204 and the torque $\tau_{knee}$ generated at the knee pitch joint 205.

Figure 8:
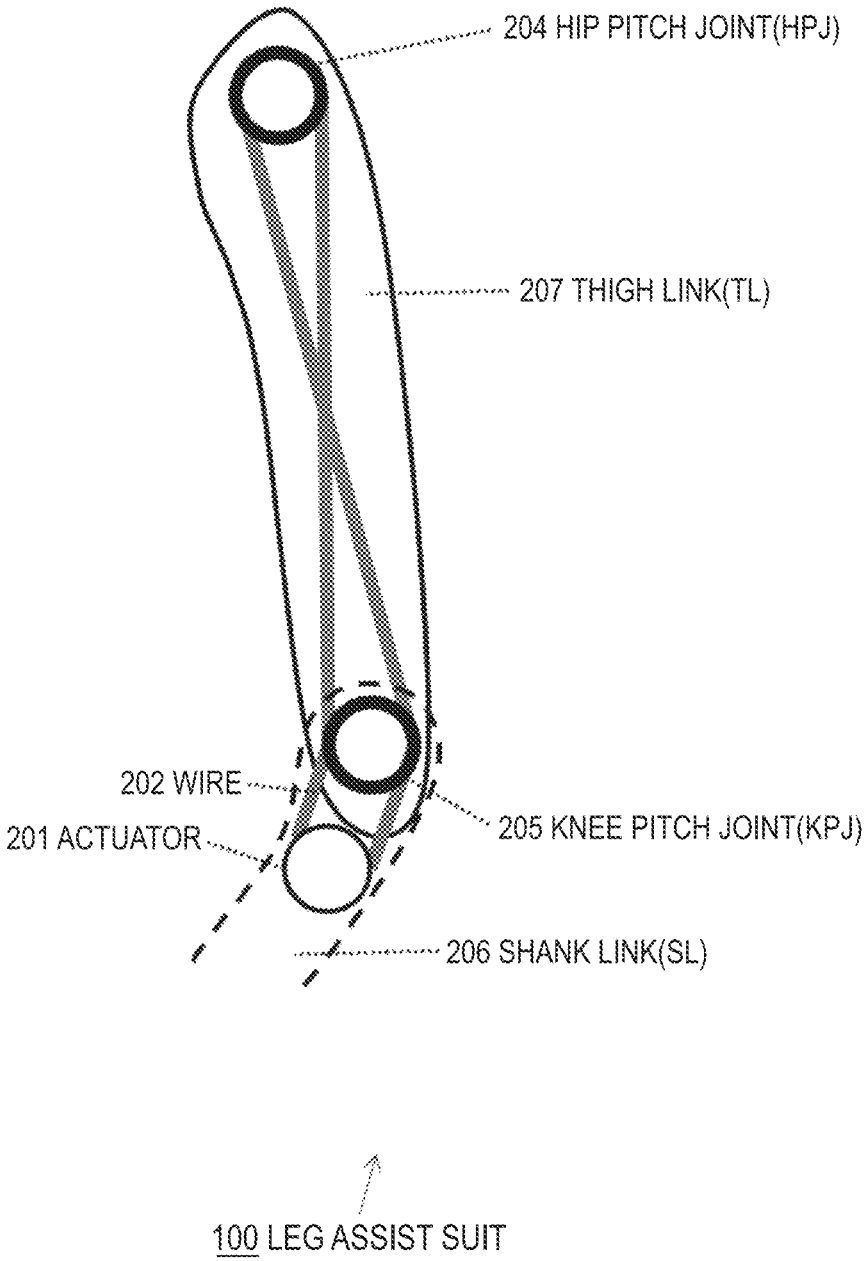
FIG. 8 is an enlarged view around the knee joint and the hip joint of the leg assist suit shown in FIG. 1 (an example configuration where the actuator 201 is installed at a shank link 206)

Thus, also in the example configuration shown in FIG. 8, since there is a restraining relationship due to the wire-coupled driving between the hip pitch joint 204 and the knee pitch joint 205, the leg assist suit 100 can simultaneously operate the knee part and the thigh part using the single actuator 201 alone.

It should be understood that the above-described force support law is valid in both of the leg part configurations shown in FIG. 2 and FIG. 8. That is, for the standing leg side, generating the torque $\tau_A$ of the actuator 201 according to the bending/stretching angle $\theta_{knee}$ of the knee joint (see the above Expression (7)), and for the idling leg side, generating the torque $\tau_A$ of the actuator 201 according to the bending angle $\theta_{hip}$ of the hip joint (see the above Expression (8)).

Figure 9:
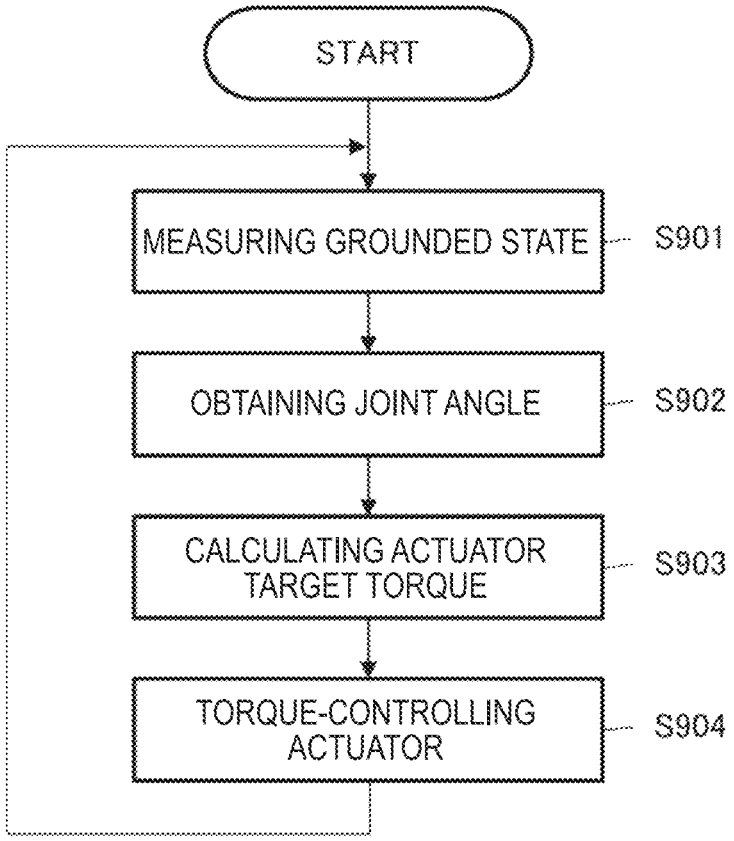
FIG. 9 is a flow chart showing a procedure for providing a supportive force to a user wearing the leg assist suit 100.

FIG. 9 shows a procedure for providing a supportive force to the user wearing the leg assist suit 100 in a form of a flow chart. This procedure is realized, for example, by the host computer 203 executing a predetermined program code.

First, the host computer 203 reads out the output of the contact sensors 211L/R mounted on the left and right foot bottoms through the microcomputers 404L/R, and determines a grounded state of each of the left and right feet (S901).

Next, he host computer 203 reads out the output of the encoder 305L/R included in the actuator 201L/R through the microcomputers 401L/R; reads out the output of the encoder 403L/R of the left and right knee joints through the microcomputers 402L/R; and obtains joint angle $\theta_{hip}$ of the hip joint and the joint angle $\theta_{knee}$ of the knee angle on the left and the right sides (S902).

Thereafter, the host computer 203 calculates the torque target values for the actuator 201L/R for each of the left and right legs on the basis of the above Expressions (7) and (8) (S903).

Then, the host computer 203 gives the torque target value obtained in the process S903 to the motor 300 inside the actuator 201 through the microcomputers 401L/R (S904).

By executing the above procedure in each control period of, for example, 10 milliseconds, the leg assist suit 100 can provide a supportive force in a natural manner to motion such as walking of the user wearing it.

The leg assist suit 100 according to the present embodiment is configured to apply a force to the multiple joints by the single actuator 201, and thereby can realize reduction in weight and price. In particular, by performing wire-coupled driving such that a certain relationship is established between the hip pitch joint 204 and the knee pitch joint 205, the leg assist suit 100 can produce effects for supporting weight of the standing leg and for pulling up the idling leg, and can realize reduction in weight without sacrificing the natural manner of providing a supportive force.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below (1) A motion assist device including:

a jth link worn on a jai portion of a user;

an ith joint unit connected at one end of an ith link in a freely rotatable manner;

a (j+1)th link worn on a (j+1)th portion of the user;

an (i+1)th joint unit integral with one end of the (j+1)th link and coupled to the other end of the jth link;

a single actuator installed at one of the jth link and a link adjacent to the jth link; and a transmission part transmitting a driving force of the actuator to the ith joint unit and the (i+1)th joint unit.

(2) The motion assist device according to (1), wherein the transmission part transmits the driving force of the actuator in a manner that a proportional relationship is established between a torque generated at the ith joint unit and a torque generated at the (i+1)th joint unit.

(3) The motion assist device according to (1), wherein the transmission part transmits the driving force of the actuator in a manner that driving directions of the ith joint unit and the (i+1)th joint unit are opposite to each other.

(4) The motion assist device according to (1), wherein the transmission part transmits the driving force of the actuator to the ith joint unit and the (i+1)th joint unit through a wire.

(5) The motion assist device according to (4), wherein the transmission part constituted of the wire is crossed between the ith joint unit and the (i+1)th joint unit.

(6) A motion assist device including:

a thigh link worn on a thigh part of a leg of a user;

a hip pitch joint connected at an upper end of the thigh link in a freely rotatable manner;

a shank link worn on a shank part of the leg;

a knee pitch joint integral with an upper end of the shank link and connected to a lower end of the thigh link;

an actuator installed at the thigh link; and a transmission part transmitting a driving force of the actuator to the hip pitch joint and the knee pitch joint.

(7) The motion assist device according to (6) above, wherein the transmission part transmits the driving force to the hip pitch joint in the same direction as a driving direction of the actuator, and transmits the driving force to the knee pitch joint in an opposite direction to the driving direction of the actuator.

(8) The motion assist device according to (6) above, wherein the transmission part is constituted of a wire wound around an output axis of the actuator, thereafter wound around the hip pitch joint in the same direction as a rotation direction of the actuator, and then wound around the knee pitch joint in an opposite direction to the rotation direction of the actuator.

(9) The motion assist device according to (8) above, wherein the transmission part constituted of the wire is crossed between the hip pitch joint and the knee pitch joint.

(10) A motion assist device, including:

a thigh link worn on a thigh part of a leg of a user;

a knee pitch joint connected at a lower end of the thigh link in a freely rotatable manner;

a pelvis link worn on the thigh part of the leg;

a hip pitch joint integral with the pelvis link and connected to an upper end of the thigh link;

an actuator installed at a shank link adjacent to the thigh link; and a transmission part transmitting a driving force of the actuator to the hip pitch joint and the knee pitch joint.

(11) The motion assist device according to (10) above, wherein the transmission part transmits the driving force to the knee pitch joint in the same direction as a driving direction of the actuator, and transmits the driving force to the hip pitch joint in an opposite direction to the driving direction of the actuator.

(12) The motion assist device according to (10), wherein the transmission part includes a wire which is wound around an output axis of the actuator, thereafter wound around the hip pitch joint in a same direction as a rotation direction of the actuator, and then wound around the knee pitch joint in an opposite direction to the rotation direction of the actuator.

(13) The motion assist device according to (12) above, wherein the transmission part constituted of the wire is crossed between the knee pitch joint and the hip pitch joint.

(14) The motion assist device according to any one of (1), (6), and (10), further including:

a target torque determining part determining a torque target value of the actuator; and an actuator control part which controls the actuator by torque control on the basis of the torque target value.

(15) The motion assist device according to (14), further including:

a joint angle measuring part which measures a joint angle of the joint unit; and a torque measuring part which measures an external torque acting on the actuator, wherein the actuator control part controls the actuator by torque control in a manner that a desired relationship is established between the joint angle measured by the joint angle measuring part and the external torque measured by the torque measuring part.

(16) The motion assist device according to (15), wherein the actuator control part includes a disturbance observer which calculates a disturbance torque $\tau_d$ at a time when the actuator is driven with a target torque $\tau_A$, wherein a joint angular acceleration target value is obtained from an ideal response model of the actuator, in which the joint angular acceleration target value, which is achieved by the actuator responding on the basis of the target torque $\tau_A$, an external torque $\tau_e$, and a joint angle speed obtained by differentiating the joint angle by time, is calculated and output, and wherein the actuator control part determines a command torque $\tau$ for the actuator in a current control period, by correcting a torque target value $\tau^{ref}$, which is obtained by multiplying the joint angular acceleration target value by an inertia nominal value $J_n$ in the actuator, with the disturbance torque $\tau_d$, which is obtained by the disturbance observer in a previous control period.

(17) The motion assist device according to (6) or (10), further including:

a state detecting part which detects whether the leg is in a state of standing leg or an idling leg;

a joint angle measuring part which measures joint angles of the hip pitch joint and the knee pitch joint; and a target torque determining part which determines the torque target value based on the joint angle of the hip pitch joint or the knee pitch joint depending on whether the leg is in the state of the standing leg or the idling leg, wherein the actuator control part controls the actuator by torque control on the basis of the torque target value.

(18) The motion assist device according to (17), wherein the target torque determining part determines the torque target value on the basis of the joint angle of the knee pitch joint when the leg is the standing leg, and determines the torque target value based on the joint angle of the hip pitch joint when the leg is the idling leg.

(19) The motion assist device according to (17), wherein the state detecting part includes a contact switch which determines whether or not a foot part of the leg is grounded.

(20) A motion assist method for assisting motion of a user using the motion assist device according to any one of (1), (6), and (10) above, including:

determining a target torque for the actuator; and controlling the actuator by torque control on the basis of the torque target value.

(21) A motion assist method for assisting motion of the user using the motion assist device according to (6) or (10), including:

detecting whether the leg is in a state of the standing leg or the idling leg;

measuring joint angles of the hip pitch joint and the knee pitch joint;

determining the torque target value based on the joint angle of the hip pitch joint or the knee pitch joint depending on whether the leg is in the state of the standing leg or the idling leg; and controlling the actuator by torque control on the basis of the torque target value.

(22) The motion assist method according to (21) above, wherein in determining the target torque, when the leg is the standing leg, the torque target value is determined on the basis of the joint angle of the knee pitch joint, and when the leg is the idling leg, the torque target value is determined on the basis of the joint angle of the hip pitch joint.

The technology of the present disclosure has been described in detail above with reference to the specific embodiments. However, it is obvious that those skilled in the art can make corrections or substitutions to the embodiments within the scope of the technology of the present disclosure.

In this specification, the description has been centered on the embodiment in which the technology of the present disclosure is applied to the leg assist suit. However, the scope of the technology of the present disclosure is not limited to this. The technology of the present disclosure can be applied to various types of assist suits worn on portions of a person other than the leg to assist various motions of the person other than walking.

In other words, the technology of the present disclosure has been described in a form of exemplification, and the description contained in this specification is not to be interpreted as limiting. Consideration should be given to the scope of the claims in order to determine the scope of the technology of the present disclosure.

The present disclosure contains subject matter related to that disclosed in Japanese Priority Patent Application IP 2012-221907 filed in the Japan Patent Office on Oct. 4, 2012, the entire content of which is hereby incorporated by reference.

What is claimed is:

1. A device comprising:

a first link;

a first joint connected at one end of the first link in a freely rotatable manner;

a second link;

a second joint integral with one end of the second link and coupled to the other end of the first link;

a single actuator installed at one of the first link, the second link, and a third link adjacent to the first link, wherein the single actuator is installed at a separate location from both of the first joint and the second joint; and a transmission part configured to transmit a driving force of the single actuator to both of the first joint and the second joint through a wire that is wound around an output axis of the single actuator and crossed between the first joint and the second joint, such that the wire is wound around the first joint in a same direction as a winding direction of the wire around the output axis of the single actuator, and then the wire is wound around the second joint in an opposite direction to the winding direction of the wire around the output axis of the single actuator.

2. The device according to claim 1, wherein the transmission part is further configured to transmit the driving force of the single actuator in a manner that a proportional relationship is established between a torque generated at the first joint and a torque generated at the second joint.

3. The device according to claim 1, wherein the transmission part is further configured to transmit the driving force of the single actuator in a manner that driving directions of the first joint and the second joint are opposite to each other.

4. The device according to claim 1, wherein the first link is a thigh link configured to be worn on a thigh part of a leg of the user, wherein the first joint is a hip pitch joint connected at an upper end of the thigh link in a freely rotatable manner, wherein the second link is a shank link configured to be worn on a shank part of the leg, wherein the second joint is a knee pitch joint integral with an upper end of the shank link and coupled to a lower end of the thigh link, and wherein the single actuator is installed at the thigh link.

5. The device according to claim 4, further comprising:

a state detecting part configured to detect whether the leg is in a state of standing leg or an idling leg;

a joint angle measuring part configured to measure joint angles of the hip pitch joint and the knee pitch joint; and a target torque determining part configured to determine a torque target value based on the joint angle of the hip pitch joint or the knee pitch joint depending on whether the leg is in the state of the standing leg or the idling leg, wherein an actuator control part is configured to control the single actuator by torque control on the basis of the torque target value.

6. The device according to claim 5, wherein the target torque determining part is further configured to determine the torque target value on the basis of the joint angle of the knee pitch joint when the leg is the standing leg, and determine the torque target value based on the joint angle of the hip pitch joint when the leg is the idling leg.

7. The device according to claim 5, wherein the state detecting part includes a contact switch configured to determine whether or not a foot part of the leg is grounded.

8. The device according to claim 1, wherein the first link is a thigh link configured to be worn on a thigh part of a leg of the user, wherein the second joint is a knee pitch joint connected at a lower end of the thigh link in a freely rotatable manner, wherein the third link is a pelvis link configured to be worn adjacent to the thigh part of the leg, wherein the first joint is a hip pitch joint integral with the pelvis link and coupled to an upper end of the thigh link, and wherein the single actuator is installed at the second link, which is a shank link adjacent to the thigh link.

9. The device according to claim 1, further comprising:

a target torque determining part determining a torque target value of the single actuator; and an actuator control part configured to control the single actuator by torque control on the basis of the torque target value.

10. The device according to claim 9, further comprising:

a joint angle measuring part configured to measure a joint angle of each joint of the first joint and the second joint; and a torque measuring part configured to measure an external torque acting on the single actuator, wherein the actuator control part is further configured to control the single actuator by torque control in a manner that a desired relationship is established between the joint angle of each joint measured by the joint angle measuring part and the external torque measured by the torque measuring part.

11. The device according to claim 10, wherein the actuator control part includes a disturbance observer which calculates a disturbance torque $\tau_d$ at a time when the single actuator is driven with a target torque $\tau_A$, wherein the actuator control part is further configured to control the single actuator by the torque control based on a joint angular acceleration target value obtained from an ideal response model of the single actuator, in which the joint angular acceleration target value, which is achieved by the single actuator responding on the basis of the target torque $\tau_A$, an external torque $\tau_e$, and a joint angle speed obtained by differentiating the joint angle by time, is calculated and output, wherein the actuator control part is further configured to determine a command torque $\tau$ for the single actuator in a current control period by correcting a torque target value $\tau^{ref}$, wherein the torque target value $\tau^{ref}$ is obtained by multiplying the joint angular acceleration target value by an inertia nominal value $J_n$ in the single actuator, and wherein the torque target value $\tau^{ref}$ is corrected with the disturbance torque $\tau_d$, which is obtained by the disturbance observer in a previous control period.

12. A method for assisting motion of the user using the device according to claim 4, the method comprising:

detecting whether the leg is in a state of the standing leg or the idling leg;

measuring joint angles of the hip pitch joint and the knee pitch joint;

determining a torque target value based on the joint angle of at least one of the hip pitch joint and the knee pitch joint depending on whether the leg is in the state of the standing leg or the idling leg; and controlling the single actuator by torque control on the basis of the torque target value.

* * * * *